US008434185B1

(12) United States Patent
Beaver, Sr.

(10) Patent No.: US 8,434,185 B1
(45) Date of Patent: May 7, 2013

(54) PIPE CLEANER ASSEMBLY

(76) Inventor: Charles W. Beaver, Sr., Salisbury, NC (US)

( * ) Notice: Subject to any disclaimer, the term of this patent is extended or adjusted under 35 U.S.C. 154(b) by 0 days.

(21) Appl. No.: 13/104,431

(22) Filed: May 10, 2011

(51) Int. Cl.
*B08B 9/027* (2006.01)

(52) U.S. Cl.
USPC ..... 15/104.05; 15/104.2; 15/104.095; 15/206

(58) Field of Classification Search ..... 15/104.2, 15/104.095, 206, 104.05
See application file for complete search history.

(56) References Cited

U.S. PATENT DOCUMENTS

| | | | | |
|---|---|---|---|---|
| 2,296,514 | A * | 9/1942 | Gibson | 166/171 |
| 2,866,212 | A | 12/1958 | White et al. | |
| 2,895,155 | A * | 7/1959 | Peterson | 15/192 |
| 2,972,157 | A * | 2/1961 | Peterson | 15/206 |
| 3,124,823 | A * | 3/1964 | Charvat | 15/206 |
| 4,286,416 | A * | 9/1981 | Cooper, Jr. | 451/466 |
| 4,619,345 | A * | 10/1986 | Rands | 184/109 |
| 4,850,071 | A | 7/1989 | Lawrence | |
| D308,623 | S | 6/1990 | Nishiki | |
| 5,406,669 | A | 4/1995 | Lesiw | |
| 5,488,747 | A * | 2/1996 | Woodhouse | 15/23 |
| 5,636,400 | A | 6/1997 | Young | |
| 5,809,601 | A | 9/1998 | Rivera | |
| D454,003 | S | 3/2002 | Saxon | |
| D521,241 | S | 5/2006 | Dimmerling | |
| 7,721,379 | B2 * | 5/2010 | Takahashi | 15/167.1 |
| 2005/0060825 | A1 * | 3/2005 | Hillenbrand | 15/104.2 |
| 2005/0172437 | A1 * | 8/2005 | Wachter | 15/179 |
| 2009/0139535 | A2 * | 6/2009 | Gueret | 132/200 |

* cited by examiner

*Primary Examiner* — Randall Chin

(57) ABSTRACT

A pipe cleaner assembly is provided for facilitating removal of burrs and debris from an interior surface of a pipe. The pipe cleaner assembly includes an elongated core having a first end and a second end. The first end is configured for attachment to a power tool to selectively rotate the core. A plurality of bristles is provided. Each bristle has a base coupled to the core between the first and second ends. The base of each bristle is coupled to the core so that a free end of the bristle extends from the core. The bristles are aligned along a length of the core.

9 Claims, 2 Drawing Sheets

PIPE CLEANER ASSEMBLY

BACKGROUND OF THE DISCLOSURE

1. Field of the Disclosure

The disclosure relates to pipe cleaning devices and more particularly pertains to a new pipe cleaning device for facilitating removal of debris from an interior surface of a pipe.

2. Summary of the Disclosure

An embodiment of the disclosure meets the needs presented above by generally comprising an elongated core having a first end and a second end. The first end is configured for attachment to a power tool to selectively rotate the core. A plurality of bristles is provided. Each bristle has a base coupled to the core between the first and second ends. The base of each bristle is coupled to the core so that a free end of the bristle extends from the core. The bristles are aligned along a length of the core.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
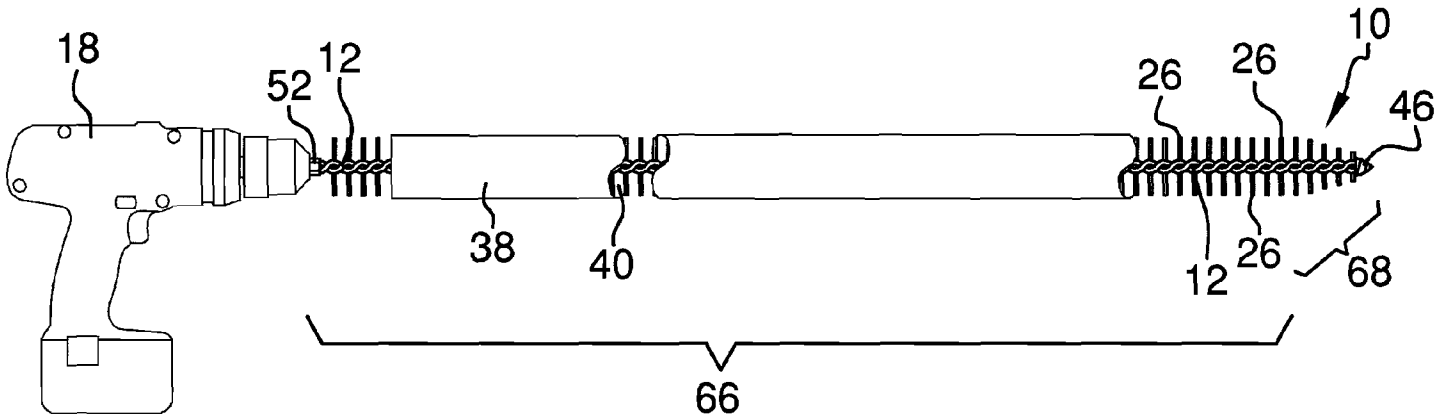
FIG. 1 is a side in-use view of a pipe cleaner assembly according to an embodiment of the disclosure.
Figure 2:
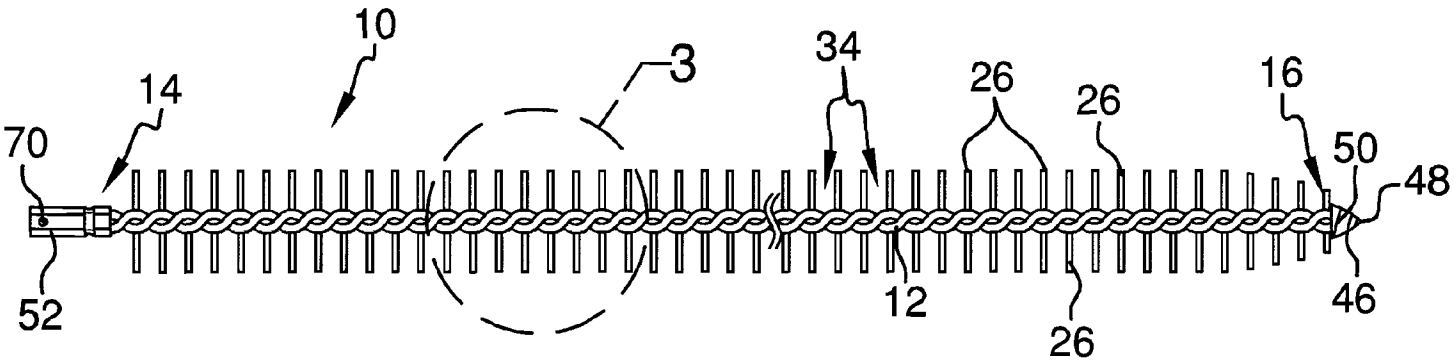
FIG. 2 is a side view of an embodiment of the disclosure.
Figure 3:
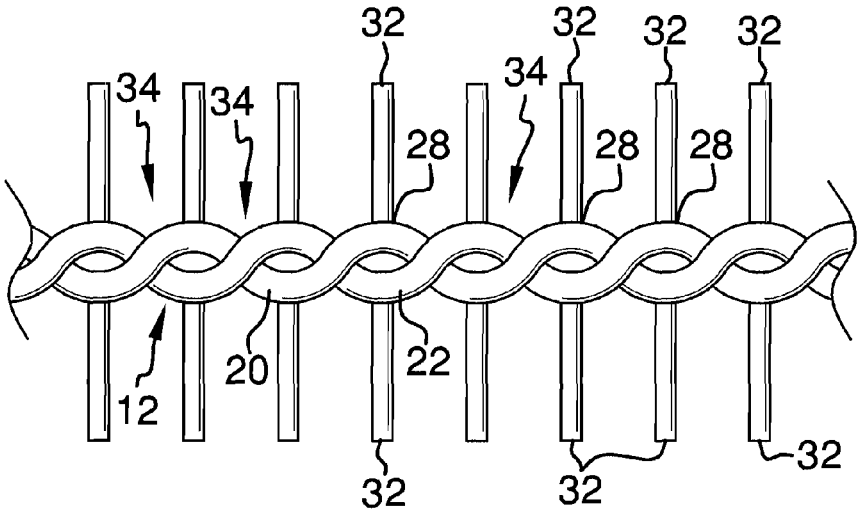
FIG. 3 is a detailed side view of an embodiment of the disclosure.
Figure 5:
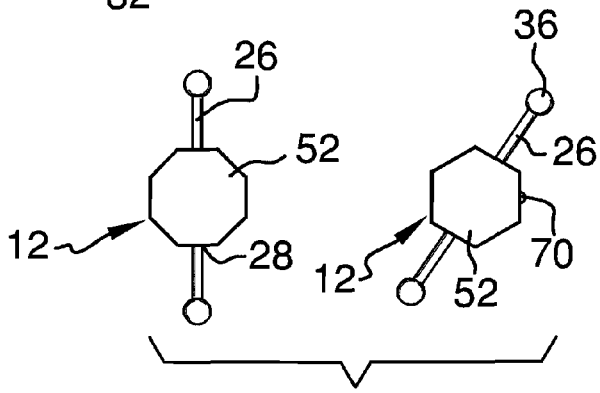
FIG. 5 is an end view of alternate embodiments of the disclosure.
Figure 4:
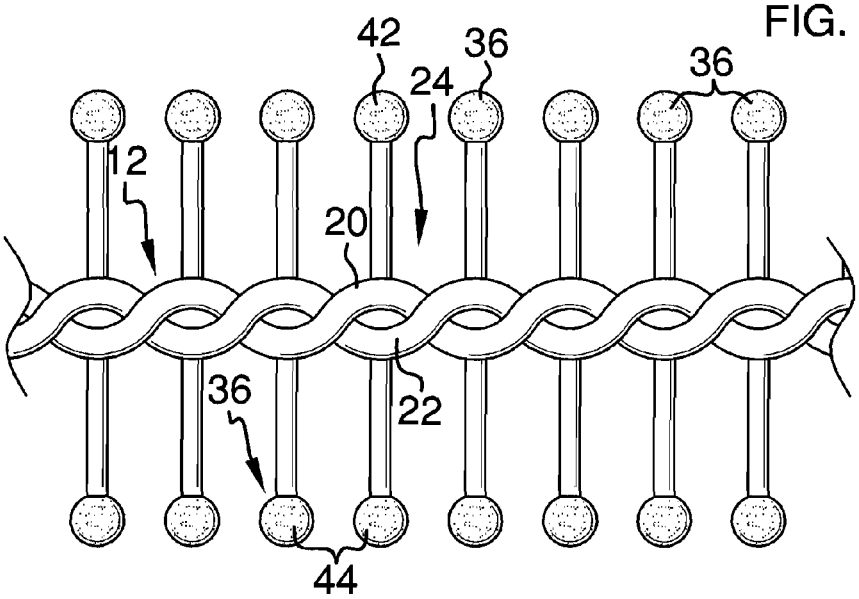
FIG. 4 is a detailed side view of an alternate embodiment of the disclosure.

With reference now to the drawings, and in particular to FIGS. 1 through 5 thereof, a new pipe cleaning device embodying the principles and concepts of an embodiment of the disclosure and generally designated by the reference numeral 10 will be described.

As best illustrated in FIGS. 1 through 5, the pipe cleaner assembly 10 generally comprises an elongated core 12 having a first end 14 and a second end 16. The first end 14 is configured for attachment to a power tool 18 to selectively rotate the core 12. The core 12 is a pair of wire segments 20,22 wrapped together into a double helix formation 24. While the Figures show two segments, 20 and 22, it should be understood that the number of segments may increase for both strengthening purposes and for providing additional bristle mounting locations. Thus, for particularly difficult cleaning operations, three or more segments may be utilized. A plurality of stiff bristles 26 is provided. Each bristle 26 has a base 28 and a free end 32. The base 28 of each bristle 26 is coupled to the core 12 and the bristle 26 extends outwardly from the core 12.

Along a first portion 66 of the core 12 extending from the first end 14, the bristles 26 have an equivalent length whereby the free ends 32 are equidistant from a center of the core 12. Between the second end 16 of the core 12 and the first portion 66 of the core 12, each bristle 26 increases in length from the second end 16 approaching the first portion 66 to form a tapered bristle section 68. The tapered bristle section 68 has length less than 20% of a total length of the first portion 66. The bristles 26 are aligned along a length of the core 12. Additionally, each bristle 26 is also linearly aligned with an associated one of the bristles 26 through the core 12. Each of the bristles 26 is positioned in spaced relationship to each adjacently positioned bristle 26 along the core 12 forming a plurality of gaps 34 along the length of the core 12. The bristles 26 and the segments 20, 22 may be comprised of a spring steel to allow them to bend and return to their original shape. Alternatively, depending on the task at hand, the bristles 26 and the segments 20, 22 may be made of a relatively non-bendable steel alloy, though such a material may less favorable due to permanent bending of the bristles 26 and segments 20, 22. A length of the first portion 66 may be varied depending on the length of a pipe to be cleaned. In particular, a longer length may be used when spring steel segments are used to allow the pipe cleaner assembly 10 to be extended through corners. The bristles 26 will have a length such that they form a cylinder, when the assembly 10 is rotated, having a length between ½ inch and 4 inches.

A plurality of balls 36 may be provided to facilitate frictional contact with an interior surface 40 of a pipe 38. Each free end 32 of the bristles 26 is coupled to a respective one of the balls 36. Each ball 36 has an abrasive surface 42 formed by each ball 36 being either coated by sand 44 or formed entirely out of sand bound together by a binding agent such as a resin or resin compound. Alternatively the balls 36 may be comprised of a carbide material, which may or may not be roughened, to not only clean but to also polish smooth the interior of a pipe.

An end cap 46 is coupled to the second end 16 of the core 12. The end cap 46 is cone-shaped and positioned so that the point 48 faces away from the core 12. The end cap 46 has a spirally threaded outer surface 50 oriented so that the end cap 46 drills into an impediment or clog in the pipe 38 as the core 12 is rotated by the power tool 18. The end cap 46 may be comprised of a sanding material for light sanding tasks. A shank 52 is coupled to the first end 14 of the core 12. The shank 52 may have a polygonal cross-sectional shape including either a hexagonal or octagonal cross-sectional shape to facilitate engagement to a conventional chuck assembly of the power tool 18. A biased ball bearing 70 may be coupled to the shank 52 to assist in locking the shank 52 in place.

In use, the shank 52 is attached to the power tool 18. The second end 16 of the core 12 is inserted into the pipe 38 to be cleaned. The power tool 18 is used to rotate the core 12 and end cap 46. The threaded outer surface 50 of the end cap 46 helps to draw the core 12 into the pipe 38. The stiff bristles 26 are sized to provide contact with the interior surface 40 of the pipe 38. The abrasive surface of the balls 36 coupled to the bristles 26 scrapes debris and removes burrs from the interior surface 40 of the pipe 38. The pipe cleaner assembly 10 may be provided in various lengths of core 12 and bristles 26 to accommodate varying sizes of pipes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A pipe cleaning assembly comprising:

an elongated core having a first end and a second end, said first end being configured for attachment to a power tool to selectively rotate said core said core being a pair of wire segments wrapped together into a double helix formation;

a plurality of bristles, each said bristle having a free end and a base, each said base being coupled to said core between said first and second ends, said bristles extending from said core, said bristles being aligned along a length of said core;

a plurality of balls, each said free end of said bristles being coupled to a respective one of said balls, each said ball having an abrasive surface;

an end cap coupled to said second end of said core, said end cap being cone-shaped.

2. The assembly of claim 1, wherein said bristles are stiff.

3. The assembly of claim 1, further including each said ball being coated by sand.

4. The assembly of claim 1, wherein each of said bristles is linearly aligned with an associated one of said bristles to form a structure consisting of two rows of bristles.

5. The assembly of claim 1, further including said end cap having a threaded outer surface.

6. The assembly of claim 1, further including said first end of said core having a shank.

7. The assembly of claim 6, wherein said shank has a hexagonal cross-sectional shape.

8. The assembly of claim 1, further including each of said bristles being positioned in spaced relationship to each adjacently positioned said bristle along said core forming a plurality of gaps along said length of said core.

9. A pipe cleaning assembly comprising:

an elongated core having a first end and a second end, said first end being configured for attachment to a power tool to selectively rotate said core, said core being a pair of wire segments wrapped together into a double helix formation;

a plurality of stiff bristles, each said bristle having a free end and a base, each said base being coupled to said core between said first and second ends, said bristles extending from said core, said bristles being aligned along a length of said core, each of said bristles being linearly aligned with an associated one of said bristles, each of said bristles being positioned in spaced relationship to each adjacently positioned said bristle along said core forming a plurality of gaps along said length of said core;

a plurality of balls, each said first end of said bristles and each said second end of said bristles being coupled to a respective one of said balls, each said ball having an abrasive surface formed by each said ball being coated by sand;

an end cap coupled to said second end of said core, said end cap being cone-shaped, said end cap having a threaded outer surface; and a shank coupled to said first end of said core, said shank having a hexagonal cross-sectional shape.

* * * * *